US005300891A

United States Patent [19]

Tokoro

[11] Patent Number: 5,300,891

[45] Date of Patent: Apr. 5, 1994

[54] ION ACCELERATOR

[75] Inventor: Nobuhiro Tokoro, West Newbury, Mass.

[73] Assignee: Genus, Inc., Mountain View, Calif.

[21] Appl. No.: 877,452

[22] Filed: May 1, 1992

[51] Int. Cl.[5] ..... H05H 3/04

[52] U.S. Cl. ..... 328/233; 328/228; 313/359.1

[58] Field of Search ..... 313/359.1, 361.1; 328/233, 228; 250/251, 492.21; 315/111.61, 111.81

[56] References Cited

U.S. PATENT DOCUMENTS 4,419,203 12/1983 Harper et al. ..... 250/251
4,812,775 3/1989 Klinkowstein et al. ..... 328/233
5,019,705 5/1991 Compton ..... 250/251
5,038,111 8/1991 Lo ..... 328/233
5,120,956 6/1992 Purser ..... 328/233

*Primary Examiner*—Donald J. Yusko
*Assistant Examiner*—Vip Patel
*Attorney, Agent, or Firm*—Nields & Lemack

[57] ABSTRACT

Ion accelerator characterized in that it is able to use not only a negative ion beam, but also a positive ion beam and a neutral beam, increases the efficiency of the use of the beam, and increases beam current, by using a positive ion source and a charge exchange cell, producing a negative ion beam, and providing, in a tandem type accelerator which uses this, a pre-analyzing magnet having changeable polarity and a pre-focusing lens, a beam neutralizer, and an accelerator terminal, shorting rod.

2 Claims, 7 Drawing Sheets

ION ACCELERATOR

BACKGROUND OF THE INVENTION

1. Field of the Invention

This invention relates to ion accelerators (making use of principles of tandem acceleration methods) to be use in manufacturing semiconductors.

2. Description of the Prior Art

Accompanying the high accumulation of semiconductors in recent years, increasing importance is given to high energy implant process which can freely control impurity profile in the interior of silicon substrates. Thus, present tandem acceleration principles are used most widely as a method of accelerating ions to high energy and implanting them in silicon substrates. Tandem acceleration principles are well known and are described in U.S. Pat. No. 3,353,107 and elsewhere. In this tandem acceleration principle, a negative ion beam is produced by combining a positive ion source and a charge exchange cell, or by using a sputter type negative ion source. This negative ion beam is directed into an accelerator terminal which is maintained at high positive voltage, injection-accelerated, and accelerated to the terminal voltage. Then, electrons are stripped from this accelerated negative ion beam in the accelerator terminal by causing it to pass through a gas or thin foil, and the beam is converted to a positive ion beam. This positive ion beam is accelerated again to ground potential from the accelerator terminal maintained at high positive potential and acquires its final energy.

At this time the final energy $E_{tot}$ (eV) of the ions may be shown as $$E_{tot}(eV)=E_{inj}\times Q\,X\,(N+1)V_{ter}$$

where $E_{inj}$(eV) is the injection energy into the accelerator, $V_{ter}$(Volt) is the terminal potential, N is the charge number of the positive ions and Q (Coulomb) is the magnitude of the electronic charge, and one can use the impressed terminal voltage efficiently in accelerating the particles.

As an example of an actual apparatus which uses this tandem principle, the construction of a Genus Inc. model G1500 high energy ion implanting apparatus, modified by omitting a pre-acceleration tube now used on the model G1500, is shown in FIG. 1. For an understanding of such prior art devices reference is also made to U.S. Pat. No. 4,980,556.

In this apparatus positive ions are produced by a hot-cathode PIG ion source 1. These positive ions are extracted as a beam by impressing a high positive voltage on the ion source. The extracted positive ion beam collides with magnesium vapor when passing through a charge exchange cell 2 which is set up immediately after the extraction electrode system, and some of the positive ions in the positive ion beam pick up two electrons from the magnesium and are converted to a negative ion beam.

After passing through the charge exchange cell 2, this beam is analyzed according to the charge state and the mass of the ions therein by means of a 90-degree analyzing magnet 3, and only the desired negative ions are injected into the tandem accelerator 5.

This mass-analyzed negative ion beam, by means of the pre-Q lens 4 which is furnished at the entrance aperture part of the low-energy acceleration tube 6 of the tandem accelerator 5, receives a focusing action such as to create a beam waist at the center of the stripper canal 7 which is provided in the tandem accelerator terminal part. At this time, the negative ion beam is simultaneously accelerated towards the tandem accelerator terminal part which is maintained at a high positive potential.

When this accelerated negative ion beam passes through the stripper canal 7, it loses orbital electrons by colliding with nitrogen gas which is introduced into the stripper canal 7, and is converted again into a positive ion beam. At this time, the distribution of charge states is determined by the energy of the collisions, and more multi-charged ions are produced at the higher collision energy. An example of this charge state distribution is shown in FIG. 2 for the case of boron.

The positive ion beam which is thus obtained is directed towards ground potential from the tandem accelerator terminal, and is again accelerated in passing through the high-energy acceleration tube 8.

The beam which thus has its final energy receives a further focusing action by means of the post-Q-lens 9, the desired charge state is selected by means of the post-analyzing magnet 10, and is introduced into a process chamber which is provided with a target.

However, in this tandem accelerating method the useful beam current which reaches the target is regulated by the charge state distribution which arises in the accelerator terminal, and therefore, as shown in FIG. 3 for the case of boron as an example, for final energy in the range of 500 keV and below the defect occurs that beam current is drastically reduced. Moreover, the negative ion yield is generally lower by 5–15%, and therefore the defect occurs that efficiency of use of the beam is reduced. It is the object of this invention to solve these defects.

SUMMARY OF THE INVENTION

In order to achieve the aforementioned objective, the ion accelerator of this invention is characterized by providing a pre-analyzing magnet and a pre-focusing lens which are capable of changing polarity, a beam-neutralizer, an accelerator terminal shorting rod, and dividing use of the apparatus according to predetermined energy ranges into positive ion beam, neutral beam, and negative ion beam. . The beam current can be increased for final energies equal to the accelerator terminal voltage or lower, by using positive ion beam, and neutral beam, in a tandem-type ion accelerator.

BRIEF DESCRIPTION OF THE DRAWINGS

The invention may best be understood from the following detailed description thereof, having reference to the accompanying drawings, in which.

DESCRIPTION OF THE PREFERRED EMBODIMENT

Figure 1:
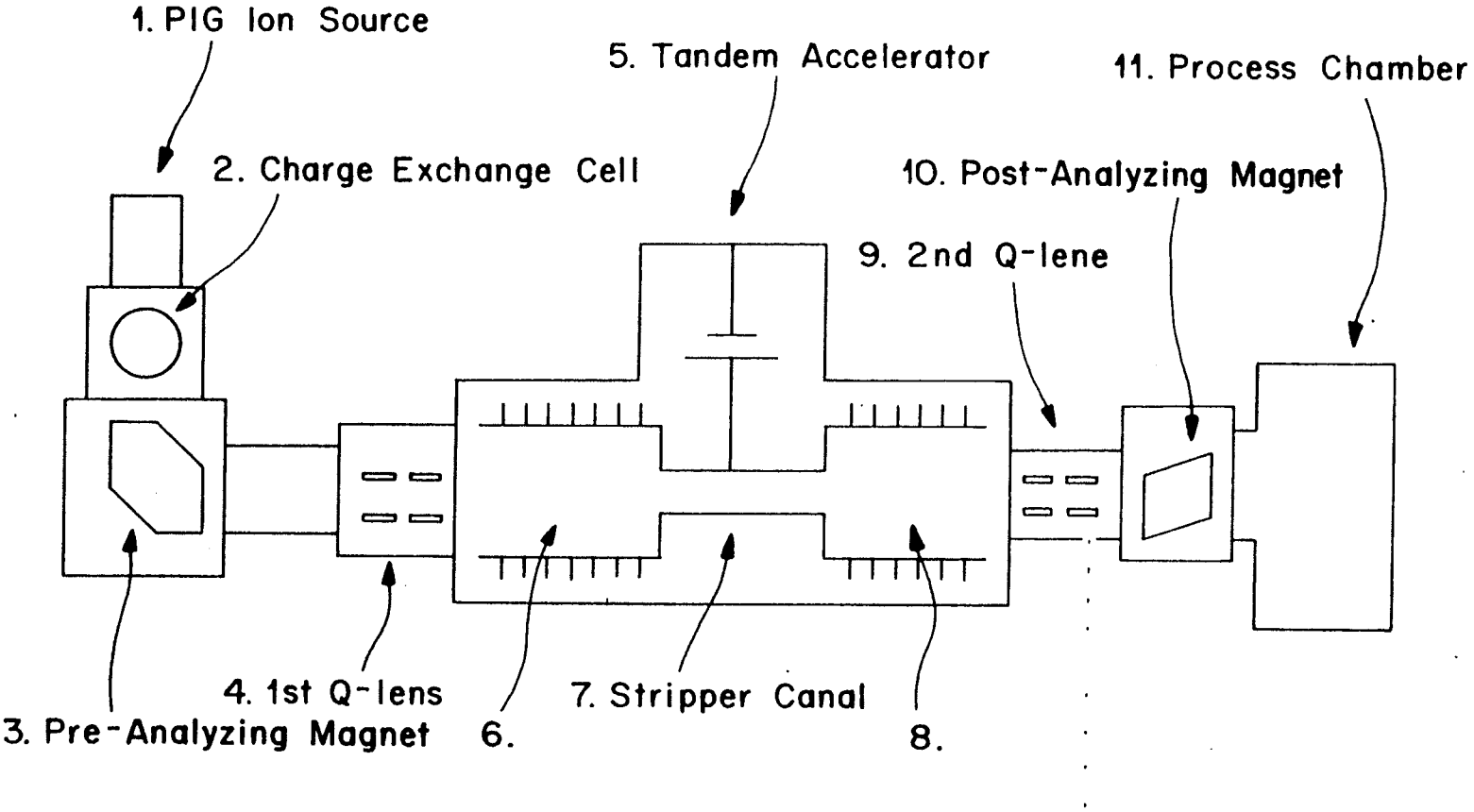
FIG. 1 PRIOR ART
FIG. 1 is a diagrammatic sketch showing the construction of prior art apparatus.
Figure 2:
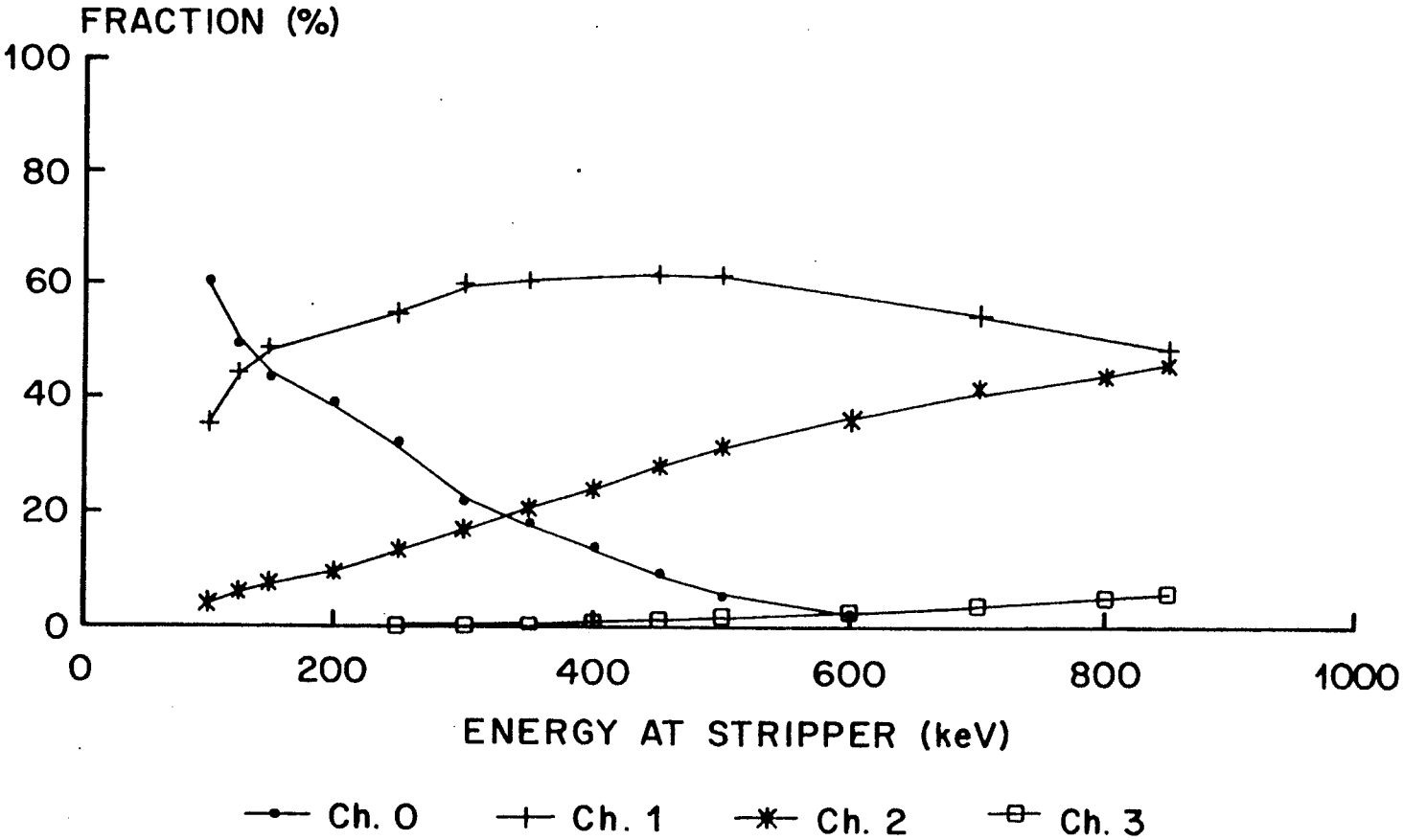
FIG. 2 PRIOR ART
FIG. 2 is a graph showing the charge state distribution for boron in the prior art apparatus of FIG. 1.
Figure 3:
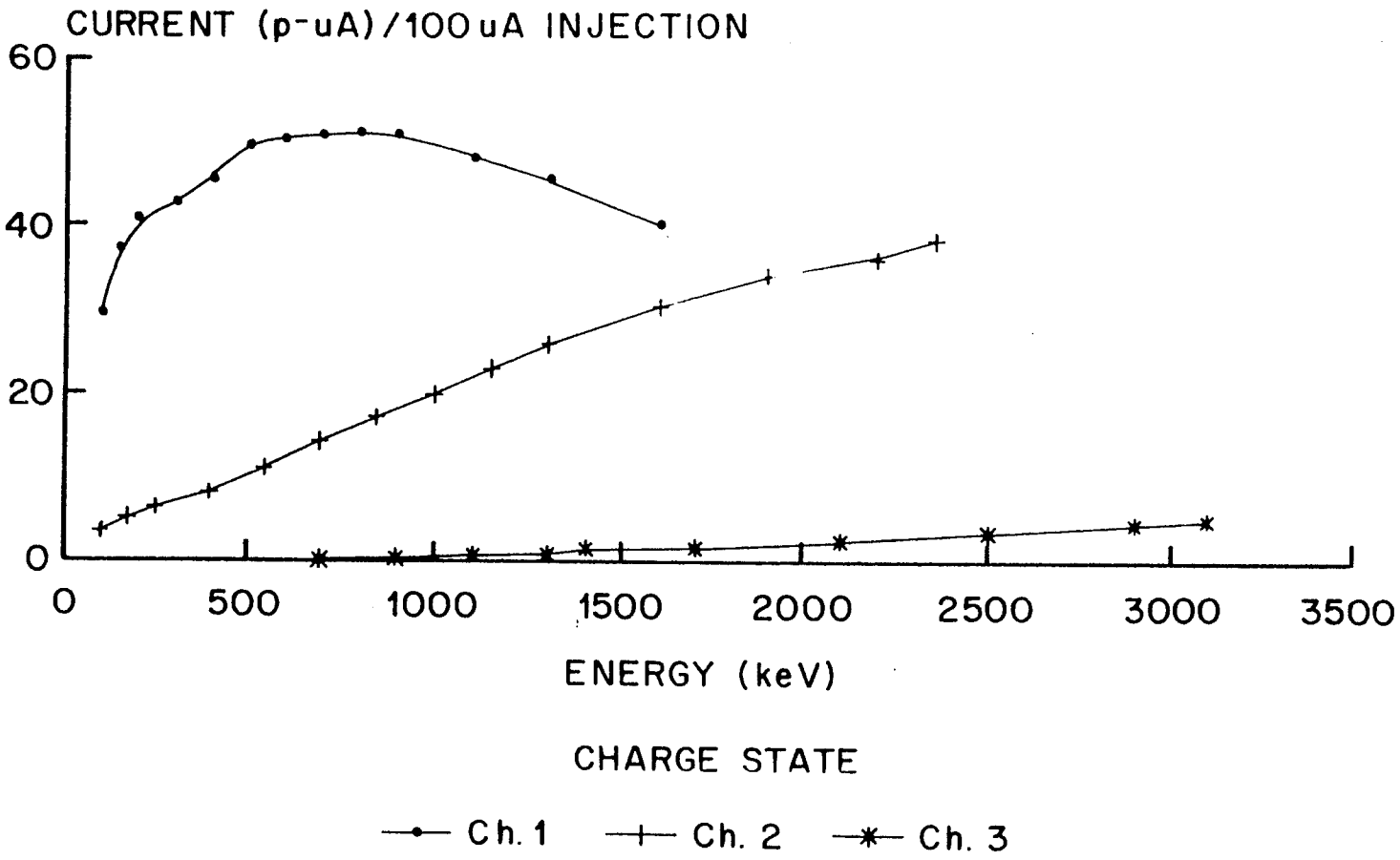
FIG. 3 PRIOR ART
FIG. 3 is a graph showing the normalized beam current for boron in the prior art apparatus of FIG. 1.
Figure 4:
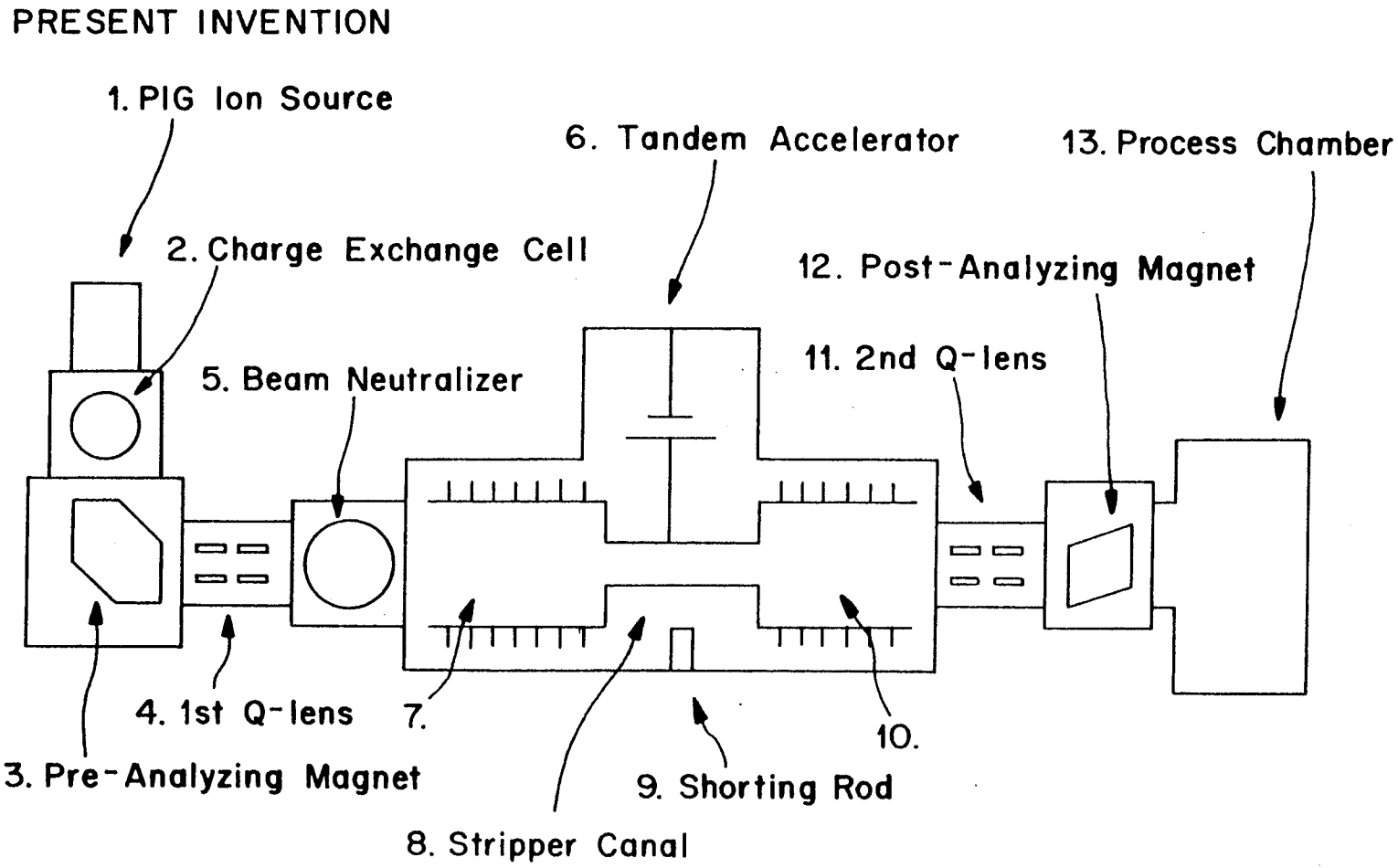
FIG. 4 is a diagrammatic sketch, similar to FIG. 1, and showing one form of construction of the invention.

FIG. 4 shows the basic construction of this invention. Referring thereto, a PIG ion source 1 is maintained at a positive voltage of up to 60 kV, and positive ions are extracted as a beam. Moreover, in the accelerator terminal a positive voltage of from 0 kV to 500 kV can be maintained.

Below, the achievable final energy and the method of operation of the apparatus according to this invention will be set forth in detail.

(1) 0–60 keV

In this energy range, the accelerating energy is given solely by the voltage impressed on the ion source. Moreover, the charge exchange cell 2 is maintained at room temperature and is not used.

The positive ions which are extracted from the PIG ion source 1 are mass-analyzed by the 90-degree analyzing magnet 3 the polarity of which is set so as to analyze positive ions, are focused by the pre-Q-lens 4 the polarity of which is set so as to focus positive ions, and pass through the accelerator. At this time, the accelerator terminal is grounded by the grounding rod 9, and charge-up of the accelerator terminal is prevented. Moreover, nitrogen gas is not introduced into the stripper canal. The post-Q-lens 11 and the polarity of the 10-degree analyzing magnet 12 are fixed for proper use with respect to the usual positive ion beam.

Figure 6:
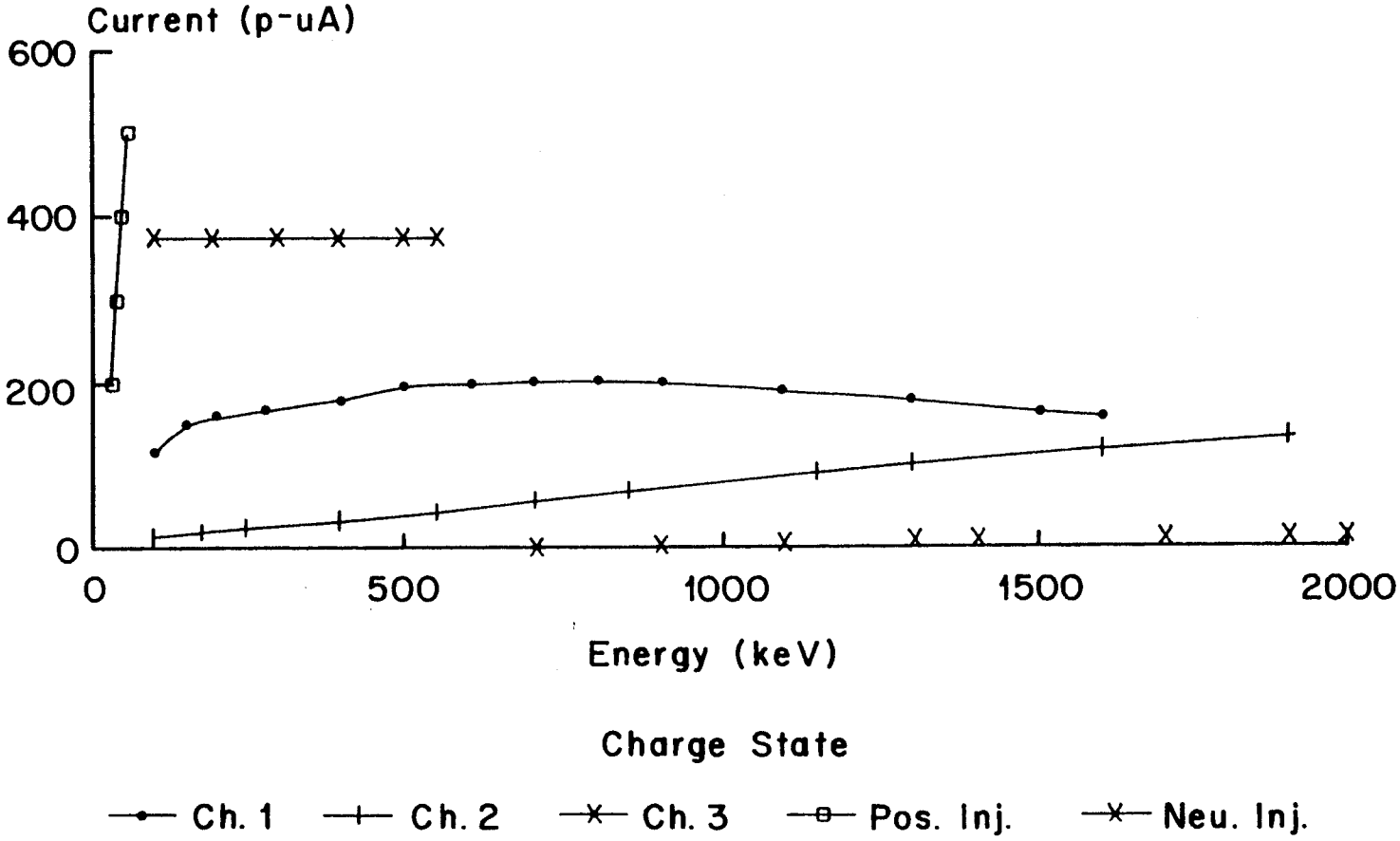
FIG. 6 is a graph showing the expected maximum beam current of boron in apparatus of the invention.
Figure 7:
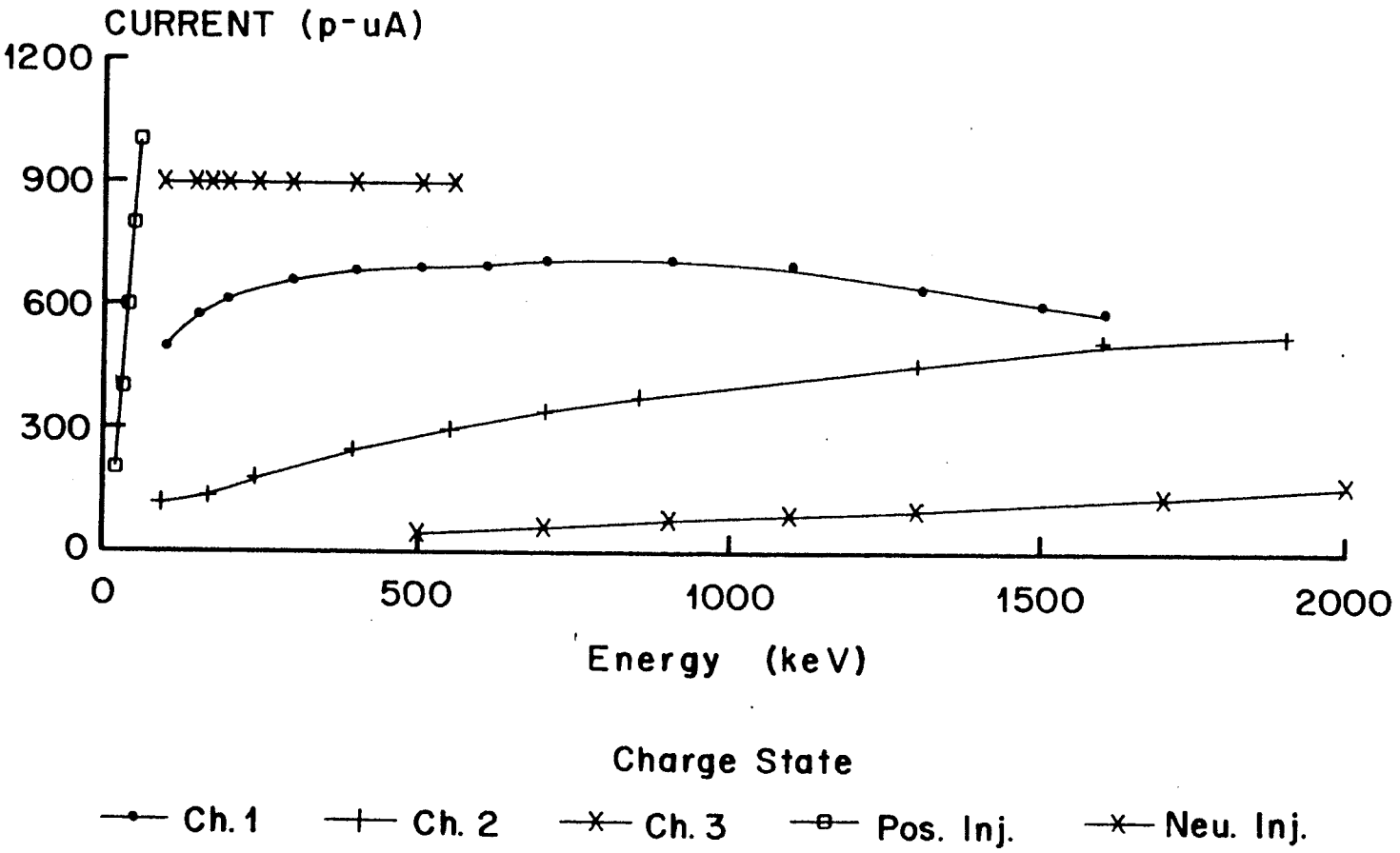
FIG. 7 is a graph showing the expected maximum beam current of phosphorus in apparatus of the invention.

The beam current which is achieved in this manner is shown in FIG. 6 and FIG. 7 for the case of boron and phosphorus. As is apparent from these figures, by this method the beam current in this energy range is increased from 2 to 10 times over the case using prior art negative ions.

(2) 6–560 keV

In this energy range, the positive ions which are extracted from the PIG ion source 1 in the same manner as in the case of (1) are mass-analyzed by the 90-degree analyzing magnet 3 the polarity of which is set so as to analyze positive ions, and is focused by the pre-Q-lens the polarity of which is set so as to focus positive ions. In this energy range, this positive ion beam is injected into the accelerator after neutralization of about 70% or more of the beam current by the beam neutralizer 5 which is provided between the pre-Q-lens 4 and the low-energy acceleration tube 7. At this time, the positive ion beam first receives focusing action by the pre-Q-lens, and is controlled so that the beam waist is received at the center of the stripper canal, and then it is neutralized by the neutralizer. The reason for this is that if the beam is first neutralized, then one can no longer control the path of the beam by electric fields and magnetic fields.

Figure 5:
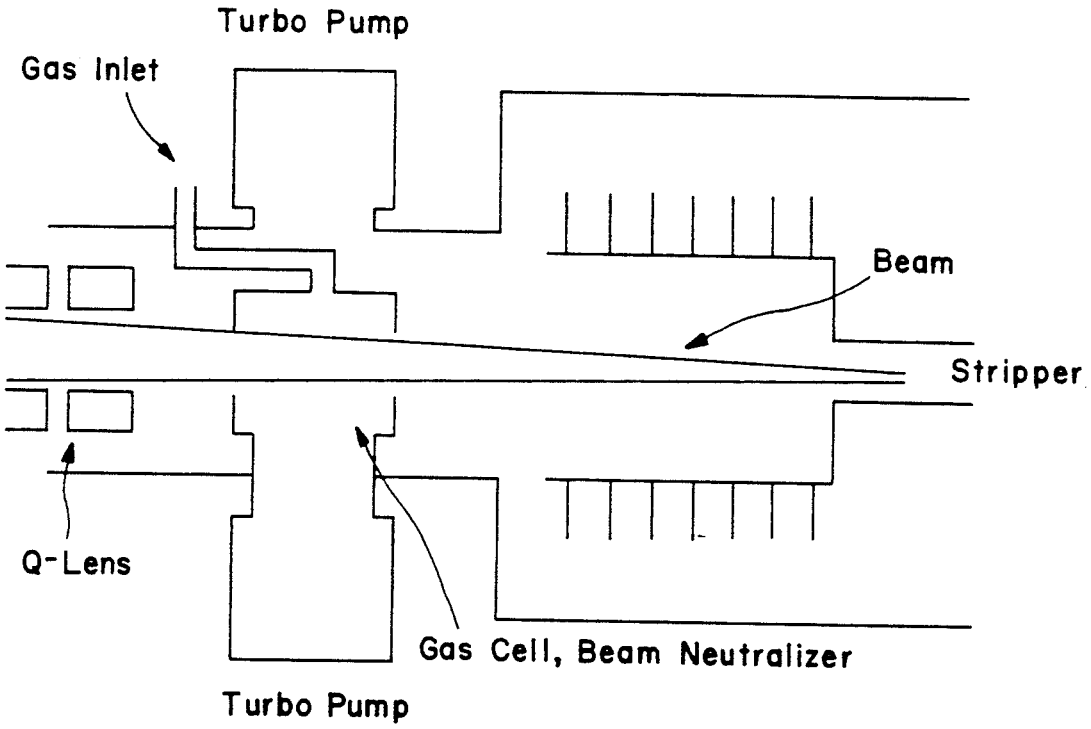
FIG. 5 is a diagrammatic sketch showing one form of construction of neutralizing apparatus according to the invention.

The basic construction of this beam neutralizer 5 is shown in FIG. 5. As shown therein, the beam neutralizer 5 is a gas cell which provides means for introducing gas and is supplied with a turbo molecular pump. Even if a large amount of gas is introduced into the chamber, it is removed by differential pumping so as not to exert a very large influence on the vacuum region. The positive ion beam undergoes charge change by collisions with the gas which is introduced into this chamber, and is neutralized. Moreover, the gas such as $H_2$, $N_2$, $O_2$, $C_2H_6$, $CH_4$ etc. which is introduced into the chamber is selected so as to be suitable for the type ion which is injected.

The beam which has been thus neutralized and injected, for example even if a high voltage has been impressed on the accelerator terminal, reaches the accelerator terminal without acceleration owing to its lack of charge, and here by virtue of collisions here with nitrogen gas which is introduced into the stripper canal, a part is again changed into positive ions. This changed positive ion beam is directed from the accelerator terminal to ground and acquires final energy after being accelerated.

Thus, when a neutral beam is injected, the final energy may be expressed thus:

$$E_{tot}(eV)=E_{inj}+Q\times V_{ter}$$

The beam current which is achieved according to this method is shown in FIG. 6 and FIG. 7 for the case of boron and phosphorus. As is apparent from these figures, the beam current in this energy range is increased by 1.5 to 2 times over the case using the negative ions of the prior art. Moreover, because even if the voltage of the accelerator terminal is changed the collision energy at the stripper canal does not change, the beam current does not vary with the voltage on the terminal significantly.

(3) 500–1500 keV

In this energy range, the polarity of the 90-degree analyzing magnet 3 and the pre-Q-lens 4 are changed to be suitable for negative ions, and the prior art principles of tandem acceleration are applied. Viz., order to achieve energies of 500–1000 keV, singly charged ions are used, and in order to achieve energies of 1000–1500 keV doubly charged ions are used.

As described above, the ion-accelerating apparatus of this invention which uses principles of tandem acceleration methods is provided with a pre-analyzing magnet and pre-focusing lens which are capable of change of polarity, a beam neutralizer, and an accelerator terminal shorting rod, and therefore the efficiency of use of the beam is increased, and beam current is increased. This constitutes the efficacy of the invention.

Having thus disclosed the principles of the invention, together with several illustrative embodiments thereof, it is to be understood that, although specific terms are employed, they are used in a generic and descriptive sense, and not for purposes of limitation, the scope of the invention being set forth in the following claims.

I claim:

1. Ion accelerator comprising in combination a high-voltage terminal containing a stripper canal, means for maintaining said terminal at a voltage V of 0–500 kV, a low-energy acceleration tube adapted to accelerate negative ions into said terminal, a high-energy acceleration tube adapted to accelerate positive ions from said terminal, a source of positive ions, a charge exchange cell, a pre-analyzing magnet, a first Q-lens, and a beam neutralizer, means for extracting positive ions from said source and directing them successively through said charge exchange cell, said pre-analyzing magnet, said first Q-lens, said beam neutralizer, said low-energy acceleration tube, said stripper canal and said high-energy acceleration tube, whereby said directed ions enter said low-energy acceleration tube with an injection energy E keV, said charge-exchange cell being settable at either one of two settings: a first setting admitting gas and a second setting excluding gas, said pre-analyzing magnet and said first Q-lens being settable at either one of two settings: a first setting deflecting and focusing positive ions and a second setting deflecting and focusing negative ions, said beam neutralizer being settable at either one of two settings: a first setting admitting gas and a second setting excluding gas, said stripper canal being settable at either one of two settings:

a first setting admitting gas and a second setting excluding gas, and a shorting rod being settable at either one of two settings: a first setting shorting said terminal and a second setting not shorting said terminal, and means for setting said charge-exchange cell, said pre-analyzing magnet, said first Q-lens, said beam neutralizer, said stripper canal and said shorting rod as follows in order to achieve the respective final energies of ions emerging from said post-acceleration tube: namely, (1) to achieve final energies of below E keV, said charge-exchange cell to be set at its said second setting, said pre-analyzing magnet to be set at its said first setting, said first O-lens to be set at its said first setting, said beam neutralizer to be set at its said second setting, said stripper canal to be set at its said second setting, and said shorting rod to be set at its said first setting, (2) to achieve final energies of above E keV and below (V+E)keV, said charge-exchange cell to be set at its said second setting, said pre-analyzing magnet to be set at its said first setting, said first Q-lens to be set at its said first setting, said beam neutralizer to be set at its said first setting, said stripper canal to be set at its said first setting, and said shorting rod to be set at its said second setting, and (3) to achieve final energies of above (V+E)keV, said charge-exchange cell to be set at its said first setting, said pre-analyzing magnet to be set at its said second setting, said first Q-lens to be set at its said second setting, said beam neutralizer to be set at its said second setting, said stripper canal to be set at its said first setting, and said shorting rod to be set at its said second setting.

2. Ion accelerator comprising in combination a high-voltage terminal containing a stripper canal, means for maintaining said terminal at a voltage of 0–500 kV, a low-energy acceleration tube adapted to accelerate negative ions into said terminal, a high-energy acceleration tube adapted to accelerate positive ions from said terminal, a source of positive ions, a charge exchange cell, a pre-analyzing magnet, a first Q-lens, and a beam neutralizer, means for extracting positive ions from said source and directing them successively through said charge exchange cell, said pre-analyzing magnet, said first Q-lens, said beam neutralizer, said low-energy acceleration tube, said stripper canal and said high-energy acceleration tube, said charge-exchange cell being settable at either one of two settings: a first setting admitting gas and a second setting excluding gas, said pre-analyzing magnet and said first Q-lens being settable at either one of two settings: a first setting deflecting and focusing positive ions and a second setting deflecting and focusing negative ions, said beam neutralizer being settable at either one of two settings:

a first setting admitting gas and a second setting excluding gas, said stripper canal being settable at either one of two settings:

a first setting admitting gas and a second setting excluding gas, and a shorting rod being settable at either one of two settings: a first setting shorting said terminal and a second setting not shorting said terminal, and means for setting said charge-exchange cell, said pre-analyzing magnet, said first Q-lens, said beam neutralizer, said stripper canal and said shorting rod as follows in order to achieve the respective final energies of ions emerging from said post-acceleration tube: namely, (1) to achieve final energies in the range 0–60 keV, said charge-exchange cell to be set at its said second setting, said pre-analyzing magnet to be set at its said first setting, said first Q-lens to be set at its said first setting, said beam neutralizer to be set at its said second setting, said stripper canal to be set at its said second setting, and said shorting rod to be set at its said first setting, (2) to achieve final energies in the range 60–560 keV, said charge-exchange cell to be set at its said second setting, said pre-analyzing magnet to be set at its said first setting, said first Q-lens to be set at its said first setting, said beam neutralizer to be set at its said first setting, said stripper canal to be set at its said first setting, and said shorting rod to be set at its said second setting, and (3) to achieve final energies in the range 560–1560 keV, said charge-exchange cell to be set at its said first setting, said pre-analyzing magnet to be set at its said second setting, said first Q-lens to be set at its said second setting, said beam neutralizer to be set at its said second setting, said stripper canal to be set at its said first setting, and said shorting rod to be set at its said second setting.

* * * * *